US006814632B1

(12) United States Patent
Peterson

(10) Patent No.: US 6,814,632 B1
(45) Date of Patent: Nov. 9, 2004

(54) ELECTRICAL CONNECTOR SYSTEM HAVING CONTACT BODY WITH INTEGRAL NONMETALLIC SLEEVE

(75) Inventor: Ronnie G. Peterson, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/162,950

(22) Filed: Jun. 4, 2002

(51) Int. Cl.[7] ..... H01R 4/10
(52) U.S. Cl. ..... 439/877; 439/589; 439/595
(58) Field of Search ..... 439/877, 589, 439/595, 878, 882

(56) References Cited

U.S. PATENT DOCUMENTS 4,053,196 A * 10/1977 Dunaway ..... 439/462
4,572,605 A * 2/1986 Hess ..... 439/585
4,749,355 A * 6/1988 Hemmer ..... 439/63
5,348,498 A * 9/1994 Morello et al. ..... 439/877
5,882,233 A * 3/1999 Idehara ..... 439/877
6,361,342 B1 * 3/2002 Cox ..... 439/275

* cited by examiner

*Primary Examiner*—Michael C. Zarroli
(74) *Attorney, Agent, or Firm*—Karl A. Vick; Colin M. Raufer

(57) ABSTRACT

An electrical connector system has an electrical contact structure including an electrically conducting contact with a metallic contact body having a hollow tubular portion, and a metallic contactor extending from the contact body. A hollow nonmetallic sleeve is joined to and extends from the hollow tubular portion of the contact body. The nonmetallic sleeve is coaxial with the hollow tubular portion in a region where the hollow tubular portion and the nonmetallic sleeve are joined to each other. A wire is inserted through an interior of the nonmetallic sleeve and into the hollow tubular portion of the contact body and is crimped to the hollow tubular portion. The electrical contact structure is received in an electrical connector body.

20 Claims, 1 Drawing Sheet

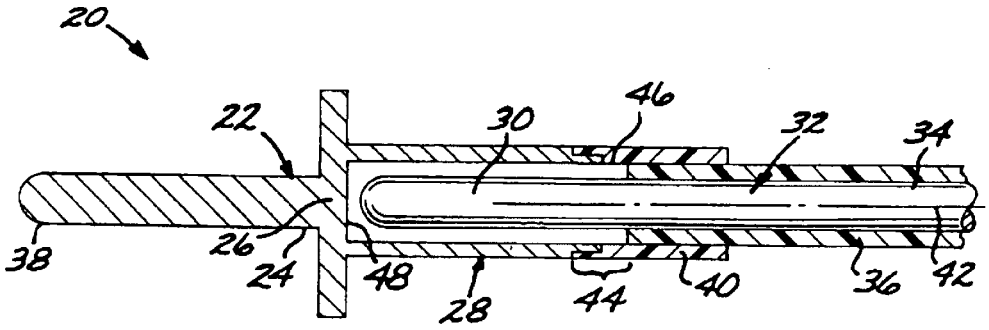
FIG. 1
FIG. 2
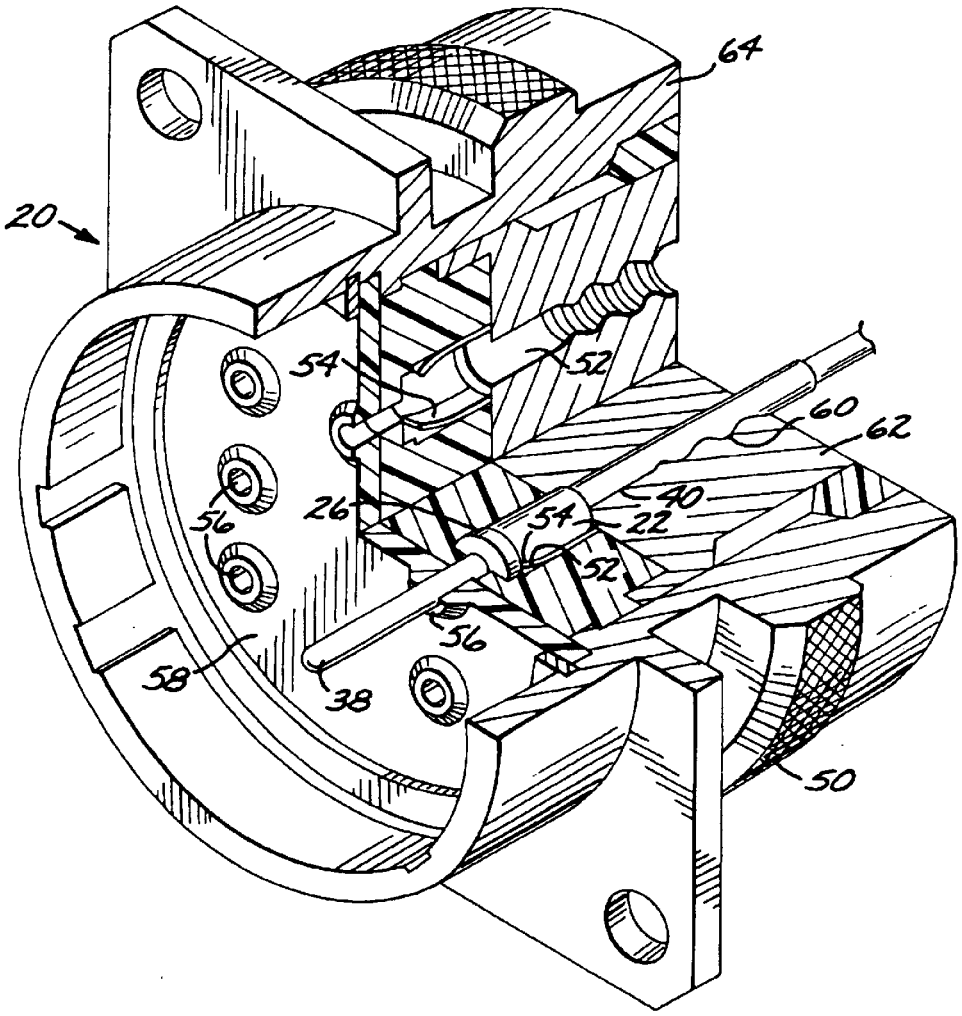

ELECTRICAL CONNECTOR SYSTEM HAVING CONTACT BODY WITH INTEGRAL NONMETALLIC SLEEVE

This invention relates to electrical connectors and, more particularly, to a contact structure by which a wire is affixed to a contact body, which is then inserted into a connector body.

BACKGROUND OF THF VENTION

In one common architecture of electrical connectors, an electrical wire that is to carry an electrical signal or serve as a ground wire is affixed to an generally cylindrical electrically conducting contact. The contact has a hollow tubular portion into which the wire is inserted. The hollow tubular portion is crushed inwardly with a tool, a process termed crimping, to establish the electrical connection between the contact and the wire. The contact structure with the wire crimped thereto is inserted into a connector body and held in place with a retention clip. A contactor portion of the contact makes electrical contact to a conforming connector when the two connectors are assembled together.

This type of connector structure has worked well for many years. Over time, however, there has been a continuing effort to reduce the weight of electrical systems, particularly those in aircraft. One aspect of this weight-reduction effort has been to reduce the diameter of the electrical wires and their insulation whenever possible. The sizes of the connectors have remained the same. However, it has been found that when a wire of diameter smaller than intended for the wire sealing range of the connector is employed, there may be a space between the inner wall of the connector grommet seals and the insulation of the wire where corrodants can find their way into the interior of the connector, leading to corrosion or electrical shorts within the connector.

The connector-manufacturing industry has proposed as a solution to this problem a new generation of connector bodies which are specifically structured for use with smaller wires. This proposed solution would be operable, but it would also entail large changeover expenses for existing electrical systems. It would also require that two (or more) different sizes of connectors be available for use in the future, one size for large wires and one size for small wires.

There is a need for an improved approach to the design and construction of electrical interconnections. The present invention fulfills this need, and further provides related advantages.

SUMMARY OF THE INVENTION

The present invention provides an electrical connector system which uses a standard size connector body and a standard size contact, but is suitable for the use of electrical wires of reduced diameter. Only one size of connector body is required for both large-diameter and small-diameter wires. The connector system is required to provide for the exclusion of corrodants even when small-diameter wires are used. The structure cannot be installed improperly, an important advantage especially in aircraft applications where these connectors are principally used. Quality control problems are thereby minimized. The present approach also allows wires of different sizes to be used with a single connector body, while avoiding corrosion problems.

In accordance with the invention, an electrical connector system has an electrical contact structure including an electrically conducting contact. The electrically conducting contact comprises a metallic contact body having a hollow tubular portion suitable for receiving an end of a wire inserted therein and forming a crimping contact to the wire, and a metallic contactor, such as a male pin contactor or a female socket, extending from the contact body. A hollow nonmetallic sleeve, preferably made of a plastic that is color coded, is joined to and extends from the hollow tubular portion of the contact body. The sleeve may be joined to the contact body by an adhesive joint. The sleeve is coaxial with the hollow tubular portion in a region where the hollow tubular portion and the sleeve are joined to each other. The wire may be inserted through an interior of the nonmetallic sleeve and into the hollow tubular portion of the contact body for crimping thereto. Preferably, the electrical contact structure is a solder-free contact structure in which no solder is required to affix the wire to the contact body.

The electrical connector system may further include a wire inserted through the sleeve and into the hollow tubular portion of the contact body and having a crimped connection with the hollow tubular portion. The sleeve seals to the insulation of the wire to prevent intrusion of liquids into the interior of the electrical contact. The electrical connector system may further include an electrical connector body in which the electrical contact structure is received.

In a preferred application, an electrical connector system has an electrical contact structure including an electrically conducting contact comprising a metallic contact body having a hollow tubular portion suitable for receiving an end of a wire inserted therein and forming a crimping contact to the wire, and a metallic contactor extending from the contact body. A hollow nonmetallic sleeve is joined to and extends from the hollow tubular portion of the contact body, so that the sleeve is coaxial with the hollow tubular portion in a region where the hollow tubular portion and the sleeve are joined to each other. A wire is inserted through the hollow interior of the sleeve and into the hollow tubular portion of the contact body and has a crimped connection with the hollow tubular portion. An electrical connector body receives the electrical contact structure. Other features as discussed above may be used with this embodiment.

Presently, Original Equipment Manufacturers (OEMs) assemble electrical connectors with small-diameter wire by using an extra piece of insulation overlying the wire, to build up the wire's outer diameter to meet the connector wire diameter sealing ranges. Putting such an extra piece of insulation on every wire, and locating it at the connector's wire seal location, is highly labor intensive. More quality inspection time is required to be certain that the extra insulation is always present. Using the extra insulation increases the procurement and inventory cost due to an additional part being included in the connector assembly. Similarly, this approach requiring the use of additional small pieces of insulation increases procurement, inventory, and labor cost for the maintenance community. It also results in maintenance quality problems, because the extra insulation is often removed and then not replaced during connector repairs. In a modern fly-by-wire aircraft, the loss of such an piece of insulation, which may permit corrodant intrusion into the connector, could become a flight safety issue. The present approach avoids these cost, quality, and safety issues.

The present approach is easy to use in new installations and in repairs. It ensures that the connector always seals around the wire so that corrodants may not penetrate into the interior of the contact body to corrode the crimped connection or cause electrical shorts. The present approach allows one size of connector, a conventional connector design, to be used for both large and small wires. The present design reduces the number of components needed to maintain the wiring system by reducing the number of different types of connectors needed to accommodate a wider range of wire sizes, and avoids the need for unique components to help the connector seal out the external environment.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a schematic view, partially in elevation and partially in section, of an electrically conducting contact and the inserted wire; and FIG. 2 is a perspective, partial sectional view of a connector body with the contact in place.

DETAILED DESCRIPTION OF THE INVENTION

FIGS. 1–2 depict an electrical connector system 20 having an electrical contact structure 22. Referring to FIG. 1, the electrical contact structure 22 includes an electrically conducting contact 24 comprising a metallic contact body 26 having a hollow tubular portion 28. The hollow tubular portion 28 is preferably generally cylindrical in its inner and outer diameters. The hollow tubular portion 28 is sized for receiving a conductor end 30 of a wire 32 inserted therein and forming a crimping contact to the wire. As used herein, the "wire" 32 includes both a metallic center conductor 34 and an insulation layer 36 overlying the center conductor 34. A metallic contactor 38, herein illustrated in the form of a male pin (but which may instead be a female socket), extends from the contact body 26. The electrically conducting contact 24 is metallic and is preferably made of gold-plated copper, silver-plated copper, or unplated constantan, alumel, chromel, or iron. The inner diameter of the hollow tubular portion 28 is selected to allow the hollow tubular portion 28 to receive wires in a series of diameters ranging from about 0.073 to about 0.300 inches, and yet be crimped onto the conductor end 30 of the wire 32 with a conventional crimping tool.

A hollow, tubular, nonmetallic sleeve 40 is joined to and extends from the hollow tubular portion 28 of the contact body 26. The sleeve 40 is preferably made of one of the insulator materials defined in the MIL-S-23053 Specification. There are a number of materials choices for the material of the sleeve 40, depending upon the temperature requirements of the connector application. Examples of suitable materials include polyvinylchloride for maximum service temperatures up to 105° C., polyolefin for maximum service temperatures in the range of 90–121° C., polytetrafluoroethylene for maximum service temperatures up to 250° C., and ethylenetetrafluoroethylene for maximum service temperatures up to 150° C. The sleeve 40 is coaxial with an axis 42 of the hollow tubular portion 28 in a joint region 44 where the hollow tubular portion 28 and the sleeve 40 are joined to each other. The sleeve 40 has an outer diameter and an inner diameter approximately, but not necessarily, the same as those of the hollow tubular portion 28. The sleeve 40 is joined to the hollow tubular portion 28 in the joint region 44 by any operable approach, with an adhesive joint 46 using a thermosetting adhesive such as an epoxy being preferred.

To attach the contact body 26 to the wire 32, the wire 32 (with the insulation layer 36 stripped from the metallic center conductor 34 near the conductor end 30) is inserted through the interior of the sleeve 40 and into the hollow tubular portion 28 of the contact body 26, so that the conductor end 30 of the wire 32 stops against a closed interior end 48 of the hollow tubular portion 28. The sleeve 40 overlaps the insulation layer 36 of the wire 32. A conventional crimping tool (not shown) is used to collapse the hollow tubular portion 28 inwardly so as to form a crimped connection with the metallic center conductor 34 of the wire 32, simultaneously ensuring that there is a close, sealing contact between the sleeve 40 and the insulation layer 36. The sealing contact between the sleeve and the insulation layer 36 prevents liquids from penetrating into the interior of the hollow tubular portion 28, where they could cause shorting and corrosion. The electrical contact structure 22 is a solder-free contact structure in which no solder is required to affix the wire 32 to the contact body 26. Such a solder-free structure allows the omission of strain reliefs and avoids other problems such as the cleaning of solder residue associated with the use of a solder.

As seen in FIG. 2, the electrical connector system 20 desirably further includes an electrical connector body 50 in which the electrical contact structure 22, prepared as described above and after crimping is complete, is received. Only one of the electrical contact structures 22 is illustrated in FIG. 2, but typically there are a number of the electrical contact structures 22 present. A bore 52 through the electrical connector body 50 receives the contact body 26 therein. A retention clip 54 engages the contact body 26 and holds it in the bore 52 with the metallic contactor 38 protruding from the electrical connector body 50 through an opening 56 in a front face 58 thereof. The opening 56 has a sealing ring therearound to prevent corrodants from penetrating into the interior of the connector body 50 from the front side of the connector.

In this position, the sleeve 40 and the attached tubular portion 28 are received in another bore 60 in a grommet 62 that is held within the electrical connector body 50. The sidewall of the bore 60 is sculptured to retain the sleeve 36 therein. Optionally in some electrical connector systems, a threaded nut 64 tightens onto matching threads on the electrical connector body 50 and over the grommet 62 to compress the grommet 62 so that it presses radially inwardly against the sleeve 40 to seal around the sleeve 40 and to prevent intrusion of corrodants into the interior of the connector body 50 from the back side of the connector.

An example is helpful in illustrating the utilization of the electrical contact structure 22 of the invention. In a conventional connector, contact, and wire combination, the outer diameter of the wire is compatible with the specified connector wire sealing range. A connector may have a specified sealing range of 0.085 to 0.105 inches outer wire diameter, for example. The connector wire would seal on this range, but in general it is preferred good engineering practice to limit the range of the outer wire diameter to about 0.087–0.103 inches. As discussed earlier, over time the industry has found ways to reduce the preferred outer diameters of the wires to less than about 0.085 inches. Because of the smaller wire outer diameter, it was possible for liquids to penetrate into the interior of the connector and attack the contact or create electrical shorts. With the present approach, the sleeve 40 seals around the exterior periphery of even, a smaller-diameter wire 32, so that liquids cannot penetrate into the interior of the connector.

Although a particular embodiment of the invention has been described in detail for purposes of illustration, various modifications and enhancements may be made without departing from the spirit and scope of the invention. Accordingly, the invention is not to be limited except as by the to appended claims.

What is claimed is:

1. An electrical connector system having an electrical contact structure including an electrically conducting contact comprising;

a metallic contact body having a hollow tubular portion suitable for receiving an end of a wire inserted therein and forming a crimping contact to the wire, and a metallic contactor extending from the contact body, and a hollow nonmetallic sleeve having a uniform inner diameter same as the inner diameter of the hollow tubular portion joined to and extending from the hollow tubular portion of the contact body, the nonmetallic sleeve being coaxial with the hollow tubular portion in a region where the hollow tubular portion and the nonmetallic sleeve are joined to each other, where the wire may be inserted through an interior of the nonmetallic sleeve and into the hollow tubular portion of the contact body for crimping thereto; and making a direct electrical connection thereto; and an electrical connector body in which the electrical contact structure is received.

2. The electrical connector system of claim 1, further including the wire inserted through the nonmetallic sleeve and into the hollow tubular portion of the contact body and having a crimped connection with the hollow tubular portion.

3. The electrical connector system of claim 1, wherein the contactor is a pin contactor.

4. The electrical connector system of claim 1, wherein the electrical contact structure is a solder-free contact structure in which no solder is required to affix the wire to the contact body.

5. The electrical connector system of claim 1, wherein the nonmetallic sleeve is made of plastic.

6. The electrical connector system of claim 1, wherein the nonmetallic sleeve is color coded.

7. The electrical connector system of claim 1, wherein the nonmetallic sleeve is joined to the contact body by an adhesive joint.

8. The electrical connector system of claim 1, wherein the electrical connector system includes at least one additional electrical contact structure as recited in claim 1, and wherein the at least one additional electrical contact structure is received in the electrical connector body.

9. The electrical connector system of claim 1, wherein the electrical contact body includes a retention clip that holds the electrical contact structure in the electrical connector body.

10. The electrical connector system of claim 1, wherein the nonmetallic sleeve is made of a material selected from the group consisting of polyvinylchloride, polyolefin, polytetrafluoroethylene, and ethylenetetrafluoroethylene.

11. An electrical connector system having an electrical contact structure including an electrically conducting contact comprising;

a metallic contact body having a hollow tubular portion suitable for receiving an end of a wire inserted therein and forming a crimping contact to the wire, and a metallic contactor extending from the contact body, a hollow nonmetallic sleeve having a uniform inner diameter same as the inner diameter of the hollow tubular portion joined to and extending from the hollow tubular portion of the contact body, the nonmetallic sleeve being coaxial with the hollow tubular portion in a region where the hollow tubular portion and the nonmetallic sleeve are joined to each other;

the wire inserted through an interior of the nonmetallic sleeve and into the hollow tubular portion of the contact body and having a crimped connection with the hollow tubular portion; and making a direct electrical connection thereto; and an electrical connector body in which the electrical contact structure is received.

12. The electrical connector system of claim 11, wherein the contactor is a pin contactor.

13. The electrical connector system of claim 11, wherein the electrical contact structure is a solder-free contact structure in which no solder is required to affix the wire to the contact body.

14. The electrical connector system of claim 11, wherein the nonmetallic sleeve is made of plastic.

15. The electrical connector system of claim 11, wherein the nonmetallic sleeve is color coded.

16. The electrical connector system of claim 11, wherein the nonmetallic sleeve is joined to the contact body by an adhesive joint.

17. The electrical connector system of claim 11, wherein the electrical connector system includes at least one additional electrical contact structure as recited in claim 9, and wherein the at least one additional electrical contact structure is received in the electrical connector body.

18. The electrical connector system of claim 11, wherein the electrical contact body includes retention clip that holds the electrical contact structure in the electrical connector body.

19. The electrical connector system of claim 11, wherein the nonmetallic sleeve is made of a material selected from the group consisting of polyvinylchloride, polyolefin, polytetrafluoroethylene, and ethylenetetrafluoroethylene.

20. An electrical connector system having an electrical contact structure including an electrically conducting contact comprising;

a metallic contact body having a hollow tubular portion suitable for receiving an end of a wire inserted therein and forming a crimping contact to the wire, and a metallic contactor extending from the contact body, and a hollow nonmetallic sleeve having a uniform inner diameter same as the inner diameter of the hollow tubular portion joined to and extending from the hollow tubular portion of the contact body, wherein the nonmetallic sleeve is coaxial with the hollow tubular portion in a region where the hollow tubular portion and the nonmetallic sleeve are joined to each other, wherein the wire may be inserted through an interior of the nonmetallic sleeve and into the hollow tubular portion of the contact body for crimping thereto, and making a direct electrical connection thereto, and wherein the nonmetallic sleeve is made of a material selected from the group consisting of polyvinylchloride, polyolefin, polytetratluoroethylene, and ethylenetetratluoroethylene.

* * * * *